US008403443B2

(12) United States Patent
Fukuda

(10) Patent No.: US 8,403,443 B2
(45) Date of Patent: Mar. 26, 2013

(54) LIQUID EJECTING APPARATUS

(75) Inventor: Shunya Fukuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/249,030

(22) Filed: Sep. 29, 2011

(65) Prior Publication Data

US 2012/0081434 A1 Apr. 5, 2012

(30) Foreign Application Priority Data

Oct. 1, 2010 (JP) ..... 2010-223578

(51) Int. Cl.
*B41J 29/38* (2006.01)

(52) U.S. Cl. ..... 347/12

(58) Field of Classification Search ..... 347/9, 12, 347/68, 70

See application file for complete search history.

(56) References Cited

U.S. PATENT DOCUMENTS

| | | | | |
|---|---|---|---|---|
| 5,541,628 | A | 7/1996 | Chang et al. | |
| 6,382,754 | B1 * | 5/2002 | Morikoshi et al. | 347/11 |
| 6,619,777 | B2 * | 9/2003 | Chang | 347/10 |
| 6,984,010 | B2 * | 1/2006 | Hosono et al. | 347/19 |

FOREIGN PATENT DOCUMENTS

| | | |
|---|---|---|
| JP | 2000-117993 | 4/2000 |
| JP | 2003-001857 | 1/2003 |
| JP | 2009-234175 | 10/2009 |

* cited by examiner

*Primary Examiner* — An Do

(74) *Attorney, Agent, or Firm* — Workman Nydegger

(57) ABSTRACT

Each of a plurality of unit ejection portions includes a pressure chamber filled with liquid, nozzles which communicate with the pressure chamber, and a piezoelectric vibrator that varies the pressure within the pressure chamber, and ejects ink from each nozzle according to the fluctuation of the pressure within the pressure chamber. A control unit controls the presence or the absence of the minute vibrations to be applied to the pressure chamber at the print period, and causes the respective unit ejection portions to execute the flushing operation so that an ejection quantity of ink by the flushing operation of the unit ejection portion, to which the minute vibrations is applied at the print period, exceeds the ejection quantity of ink by the flushing operation of the unit ejection portion to which the minute vibrations are not applied at the print period.

7 Claims, 7 Drawing Sheets

LIQUID EJECTING APPARATUS

BACKGROUND

1. Technical Field

The present invention relates to a technique that ejects liquid such as ink.

2. Related Art

A liquid ejecting technique is suggested from the past which ejects liquid (for example, ink) within a pressure chamber from nozzles by changing the pressure within the pressure chamber using a pressure generating element such as a piezoelectric vibrator or a heating element. Furthermore, JP-A-2000-117993 and JP-A-2003-001857 disclose a configuration that prevents the clogging of the nozzles or the like through a flushing operation of forcibly ejecting liquid from each nozzle.

However, the ejection quantity of liquid necessary for realizing the desired effect through the flushing operation varies according to the properties (typically, viscosity) of liquid within the pressure chamber. However, in the technique in JP-A-2000-117993 or JP-A-2003-001857, since the ejection quantity of liquid by the flushing operation is regularly maintained, there is a possibility that more liquid within the pressure chamber is consumed than necessary through the flushing operation.

SUMMARY

An advantage of some aspects of the invention is to reduce an ejection quantity of liquid by the flushing operation. A means adapted in the invention will be described. In addition, in order to facilitate the understanding of the invention in the description as below, correspondences between elements of the invention and elements of an embodiment described later will be denoted in parenthesis, but the scope of the invention is not limited to the embodiment.

A liquid ejecting apparatus of an aspect of the invention includes a plurality of unit ejection portions (for example, unit ejection portions U) which has a pressure chamber (for example, a pressure chamber 50) filled with liquid, nozzles (for example, nozzles 56) that communicate with the pressure chamber, and a pressure generating element (for example, a piezoelectric vibrator 422) that varies the pressure within the pressure chamber, respectively, and ejects liquid within the pressure chamber from each nozzle according to the fluctuation of the pressure within the pressure chamber; a minute vibration control unit (for example, a control portion 60) that controls the respective unit ejection portions so that minute vibrations having variable intensity are applied to the pressure chamber; and a flushing control unit (for example, a control portion 60) that causes the respective unit ejection portions to execute the flushing operation so that the ejection quantity (for example, a flushing ejection quantity FL1) of liquid by the flushing operation of the pressure chamber with the minute vibrations of the first intensity given thereto exceeds the ejection quantity (for example, a flushing ejection quantity FL2) of liquid by the flushing operation of the pressure chamber with the minute vibrations of the second intensity lower than the first intensity given thereto.

In the configuration mentioned above, the ejection quantity (the flushing ejection quantity) of liquid by the flushing operation of each unit ejection portion is variably controlled according to the intensity (including the presence and the absence of the minute vibrations) of the minute vibrations. Thus, as compared to a configuration in which the flushing ejection quantity is fixed to a predetermined value regardless of the intensity of the minute vibrations, it is possible to reduce the amount of ink consumed due to the flushing operation while maintaining the desired effect of the flushing operation. In addition, although only the first intensity and the second intensity were mentioned in the description above, the scope of the invention is not limited to a configuration in which the intensity of the minute vibrations is selectively set from only the two intensities of the first intensity and the second intensity. That is, even in a configuration in which the intensity of the minute vibrations can be selected from three intensities or more, a configuration which satisfies the requirements mentioned above is of course included in the scope of the invention when two of three intensities are understood as the first intensity and the second intensity.

In a preferred aspect, the minute vibration control unit may control each unit ejection portion so that the minute vibrations of any one of the first intensity and the second intensity are applied to each pressure chamber, and the second intensity may correspond to the stop (off) of the minute vibrations. In the aspect mentioned above, since the presence or the absence (on/off) of the application of the minute vibrations relative to the pressure chamber is controlled, there is an advantage in that the control of the minute vibrations is simplified as compared to a case of controlling the strength and the weakness of the minute vibrations that are actually applied to the pressure chamber. As a method of stopping the minute vibrations, although it is possible to adopt a method of maintaining the electric potential to be supplied to the pressure generating element to a predetermined value, or a method of stopping the minute vibrations by stopping the supply of the electric potential to the pressure generating element, the latter method is preferable from the viewpoint of the reduction in power consumption.

In a preferred aspect of the invention, the minute vibration control unit may discriminate the necessity of the ejection of liquid of each unit ejection portion according to the print data, may cause the unit ejection portion necessary for the ejection of liquid to execute the ejection of liquid or the application of the minute vibrations relative to the pressure chamber according to the print data, and may cause the unit ejection portion unnecessary for the ejection of liquid to execute the application of the minute vibrations of the second intensity. In the aspect mentioned above, there is an advantage in that it is possible to individually set the unit ejection portion giving the minute vibrations of the first intensity and the unit ejection portion giving the minute vibrations of the second intensity for each unit ejection portion according to the print data. In addition, a specific example of the aspects mentioned above will be described later as a first embodiment.

In a preferred embodiment, the plurality of unit ejection portions is divided into a first group (for example, a first group G1) and a second group (for example, a second group G2), the liquid ejecting apparatus may include an operation mode control unit that selects any one of a first operation mode (for example, a color print mode) of ejecting liquid from each unit ejection portion of both of the first group and the second group and a second operation mode (for example, a monochrome print mode) of ejecting liquid from each unit ejection portion of the first group and stopping the ejection of liquid by each unit ejection portion of the second group, the minute vibration control unit causes each unit ejection portion of both of the first group and the second group to execute the ejection of liquid or the application of the minute vibrations of the first intensity to the pressure chamber according to the print data when the operation mode control unit selects the first operation mode, and the minute vibration control unit causes each unit ejection portion of the first group to execute the ejection of liquid or the application of the minute vibrations of the first intensity to the pressure chamber according to the print data and causes the unit ejection portions corresponding to each nozzle of the second group to execute the application of the minute vibrations of the second intensity to the pressure chamber when the operation mode control unit selects the second operation mode. In the aspect mentioned above, there is an advantage in that it is possible to distinguish the unit ejection portion giving the minute vibrations of the first intensity and the unit ejection portion giving the minute vibrations of the second intensity according to the operation mode. In addition, a second specific example of the aspect mentioned above will be, for example, described later as a second embodiment.

Another aspect of the invention is also realized as a program for controlling a plurality of unit ejection portions (for example, unit ejection portions U) that ejects liquid within the pressure chamber from each nozzle according to the fluctuations in pressure within the pressure chamber, the plurality of unit ejection portions including a pressure chamber (for example, a pressure chamber 50) filled with liquid, nozzles (for example, nozzles 56) that communicate with the pressure chamber, and a pressure generating element (for example, a piezoelectric vibrator 422) that varies the pressure within the pressure chamber, respectively. The program of the invention causes a computer (for example, a control apparatus 102) to execute the minute vibration control processing of controlling each unit ejection portion so that the minute vibrations having variable intensity are applied to the pressure chamber, and a flushing control processing of causing the respective unit ejection portions to execute the flushing operation so that the ejection quantity (for example, a flushing ejection quantity FL1) of liquid by the flushing operation of the pressure chamber with the minute vibrations of the first intensity given thereto exceeds the ejection quantity (for example, a flushing ejection quantity FL2) of liquid by the flushing operation of the pressure chamber with the minute vibrations of the second intensity lower than the first intensity given thereto.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

Figure 1:
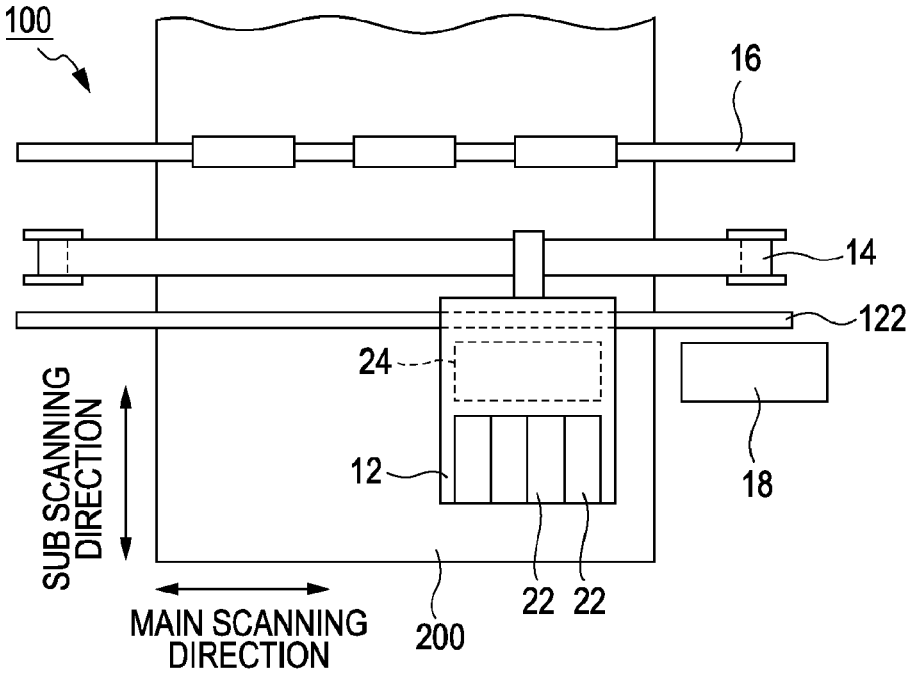
FIG. 1 is a partial schematic diagram of a print apparatus according to a first embodiment of the invention.

FIG. 1 is a partial schematic diagram of a print apparatus 100 of an inkjet type according to a first embodiment of the invention. The print apparatus 100 is a liquid ejecting apparatus that ejects ink of a minute liquid droplet shape onto a recording paper 200, and includes a carriage 12, a movement mechanism 14, a paper transportation mechanism 16, and a cap 18.

An ink cartridge 22 and a recording head 24 are placed on the carriage 12. The ink cartridge 22 is a container in which ink (liquid) to be ejected to the recording paper 200 is stored. The recording head 24 functions as a liquid discharging portion that ejects ink stored in the ink cartridge 22 onto the recording paper 200. In addition, it is also possible to adopt a configuration in which the ink cartridge 22 is fixed to a case (not shown) of the print apparatus 10 and ink is supplied to the recording head 24.

Figure 2:
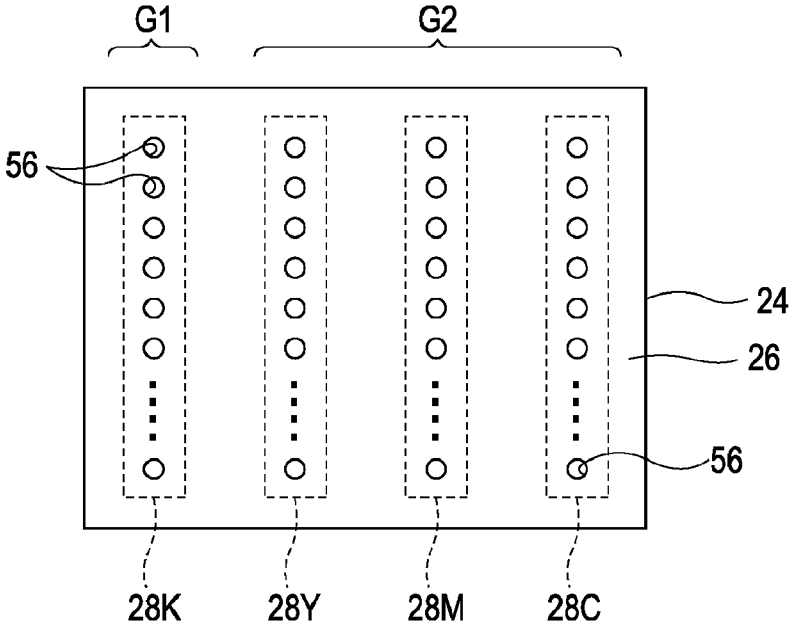
FIG. 2 is a plan view of a discharging surface of a recording head.

FIG. 2 is a plan view of a discharging surface 26 of the recording head 24 facing the recording paper 200. As shown in FIG. 2, on the discharging surface 26 of the recording head 24, a plurality of nozzle groups 28 (28K, 28Y, 28M, and 28C) corresponding to ink colors (black (K), yellow (Y), magenta (M), and cyan (C)) different from each other is formed. Each nozzle group 28 is an assembly of a plurality of nozzles (discharging ports) 56 arranged in a straight line shape in the sub scanning direction. Black (K) ink is discharged from each nozzle 56 of the nozzle group 28K. Similarly, Yellow (Y) ink is discharged from each nozzle 56 of the nozzle group 28Y, Magenta (M) ink is discharged from each nozzle 56 of the nozzle group 28M, and Cyan (C) ink is discharged from each nozzle 56 of the nozzle group 28C. In addition, a configuration is also preferable in which the respective nozzles 56 are arranged in a zigzag shape.

The movement mechanism 14 of FIG. 1 causes the carriage 12 to reciprocate along a guidance shaft 122 in a main scanning direction (a width direction of the recording paper 200). The position of the carriage 12 is detected by a detector (not shown) such as a linear encoder and is used in the control of the movement mechanism 14. The paper transport mechanism 16 moves the recording paper 200 in the sub scanning direction along with the reciprocation of the carriage 12. The recording head 24 ejects ink onto the recording paper 200 when the carriage 12 reciprocates, whereby a desired image is recorded (printed) on the recording paper 200.

The movement mechanism 14 is able to move the recording head 24 to a position (hereinafter, referred to as a "retracted position") of the outside of a range in which the discharging surface 26 faces the recording paper 200. The cap 18 is disposed so as to face the discharging surface 26 of the recording head 24 that is in the retracted position. The cap 18 seals the discharging surface 26 of the recording head 24. A wiper (not shown) wiping out the discharging surface 26 is disposed near the cap 18.

Figure 3:
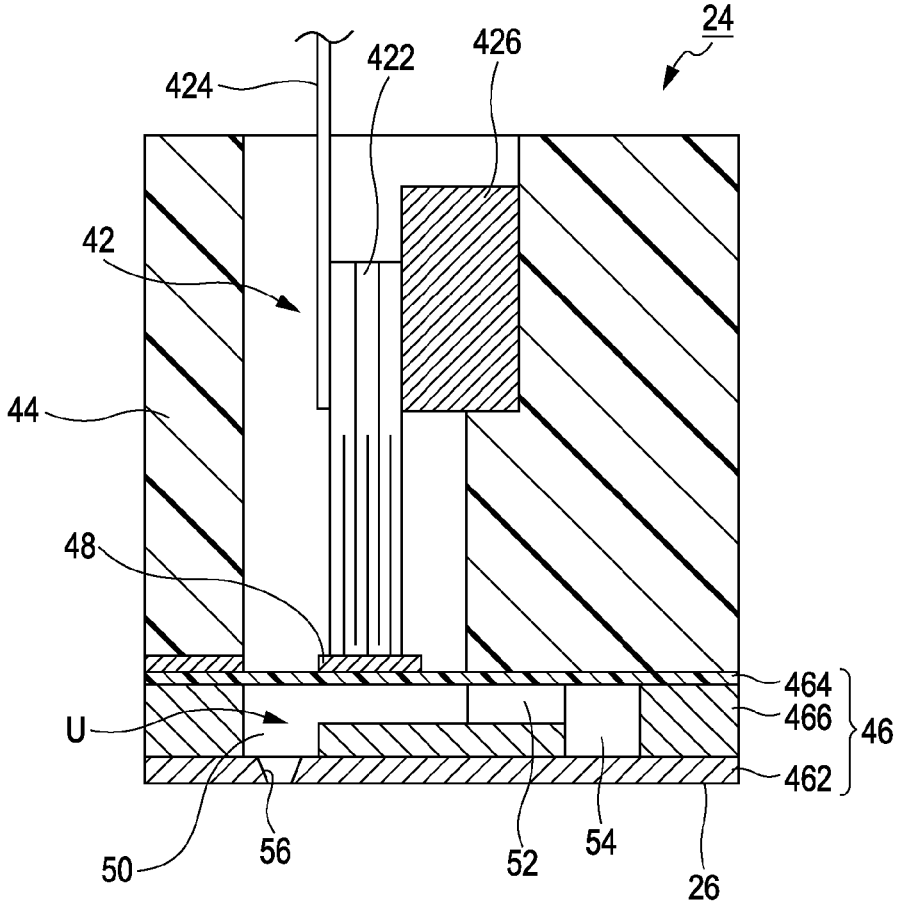
FIG. 3 is a cross-sectional view of the recording head.

FIG. 3 is a cross-sectional view (a cross-section perpendicular to the main scanning direction) of the recording head 24. As shown in FIG. 3, the recording head 24 includes a vibration unit 42, an accommodator 44, and a flow path unit 46. The vibration unit 42 includes a piezoelectric vibrator 422, a cable 424, and a fixing plate 426. The piezoelectric vibrator 422 is a vertical vibrating piezoelectric element in which a piezoelectric material and an electrode are alternately stacked, and is vibrated according to a driving signal to be supplied via the cable 424. The vibration unit 42 is accommodated in the accommodator 44 in the state in which the fixed plate 426 with the piezoelectric vibrator 422 fixed thereto is bonded to an inner wall surface of the accommodator 44.

The flow path unit 46 is a structure in which a flow path forming plate 466 is inserted into a gap (the spacing) between a substrate 462 and a substrate 464 that face each other. A surface of the substrate 462 on a side opposite to the substrate 464 corresponds to the discharging surface 26 of FIG. 2. The flow path forming plate 466 forms a space including a pressure chamber 50, a supply path 52, and a storage chamber 54 in the gap (the spacing) between the substrate 462 and the substrate 464. The pressure chamber 50 is individually divided by partitions for each vibration unit 42 and communicates with the storage chamber 54 via the supply path 52. Ink to be supplied from the ink cartridge 22 is stored in the ink storage chamber 54. Each nozzle 56 of FIG. 2 is formed in the substrate 462 so as to correspond to each pressure chamber 50. Each nozzle 56 is a through hole that communicates with the pressure chamber 50. As is understood from the description mentioned above, a flow path of ink is formed which leads from the storage chamber 54 to the outside via the supply path 52, the pressure chamber 50, and the chamber 56.

The substrate 464 is a flat plate material formed of an elastic material. In a region of the substrate 464 on a side opposite to the pressure chamber 50, a vibration plate 48 of an island shape is formed. A tip surface (a free end) of the piezoelectric vibrator 422 is bonded to the vibration plate 48. Thus, when the piezoelectric vibrator 422 is vibrated by the supply of the driving signal, the volume of the pressure chamber 50 is changed by the displacement of the substrate 464 via the vibration plate 48, whereby the pressure of ink within the pressure chamber 50 is varied. That is, the piezoelectric vibrator 422 functions as a pressure generating element that varies the pressure within the pressure chamber 50. It is possible to eject ink from the nozzle 56 according to the fluctuation of the pressure within the pressure chamber 50 mentioned above. That is, an element constituted by the piezoelectric vibrator 422, the pressure chamber 50, and the nozzles 56 functions as a unit which ejects ink (hereinafter, also referred to as a "unit ejection portion U").

Figure 4:
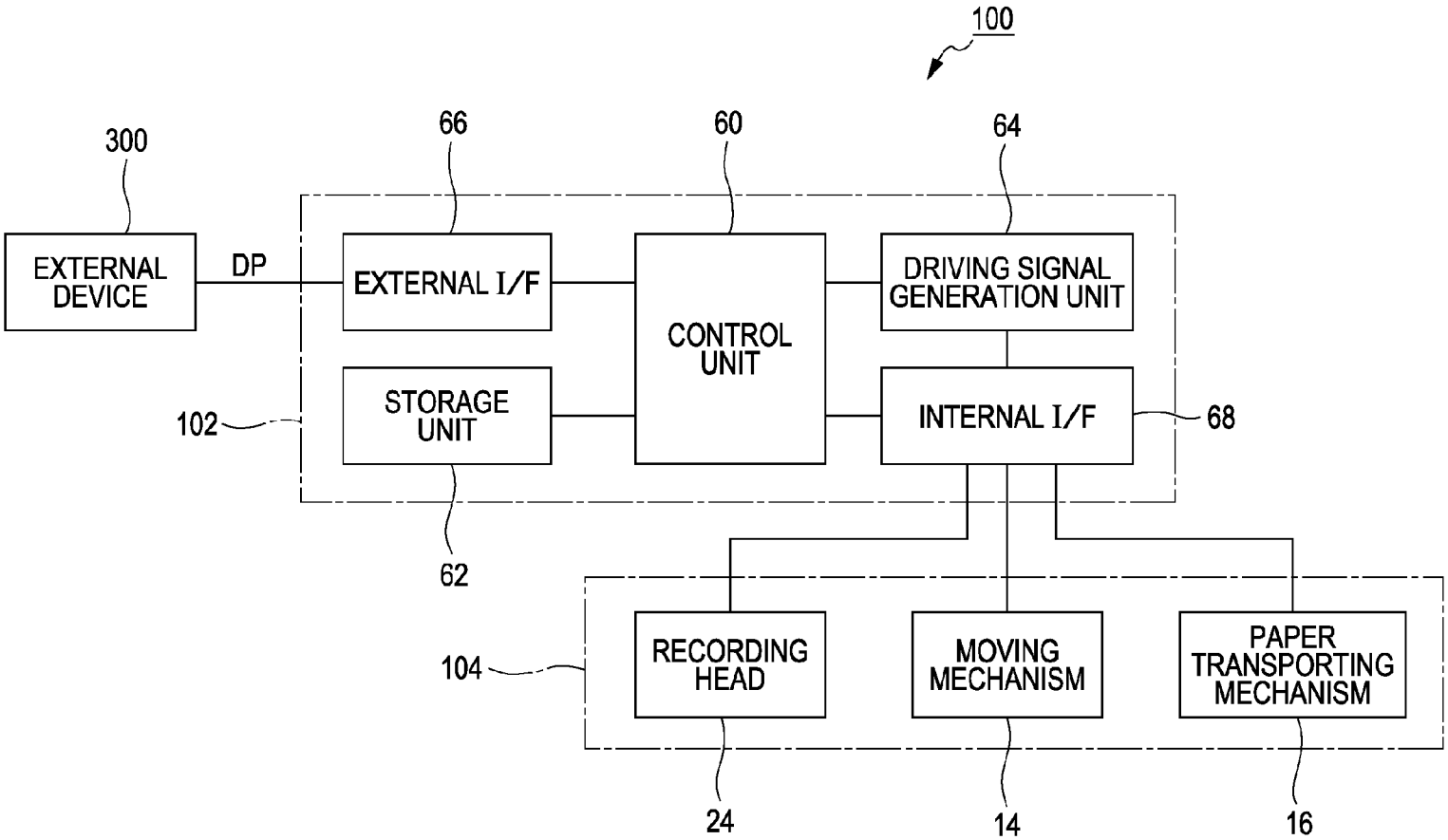
FIG. 4 is a block diagram of an electrical configuration of the print apparatus.

FIG. 4 is a block diagram of an electrical configuration of the print apparatus 100. As shown in FIG. 4, the print apparatus 100 includes a control device 102, and a print processing portion (a print engine) 104. The control device 102 is an element which controls the entire print apparatus 100, and includes a control portion 60, a storage portion 62, a driving signal generating portion 64, an external I/F (interface) 66, and an internal I/F 68. Print data DP indicating an image to be printed on the recording paper 200 is supplied from an external device (for example, a host computer) 300 to the external I/F 66, and the print processing portion 104 is connected to the inner I/F 68. The print processing portion 104 is an element which records an image on the recording paper 200 under the control by the control device 102, and includes the recording head 24, a movement mechanism 14, and the paper transport mechanism 16 mentioned above.

Figure 5:
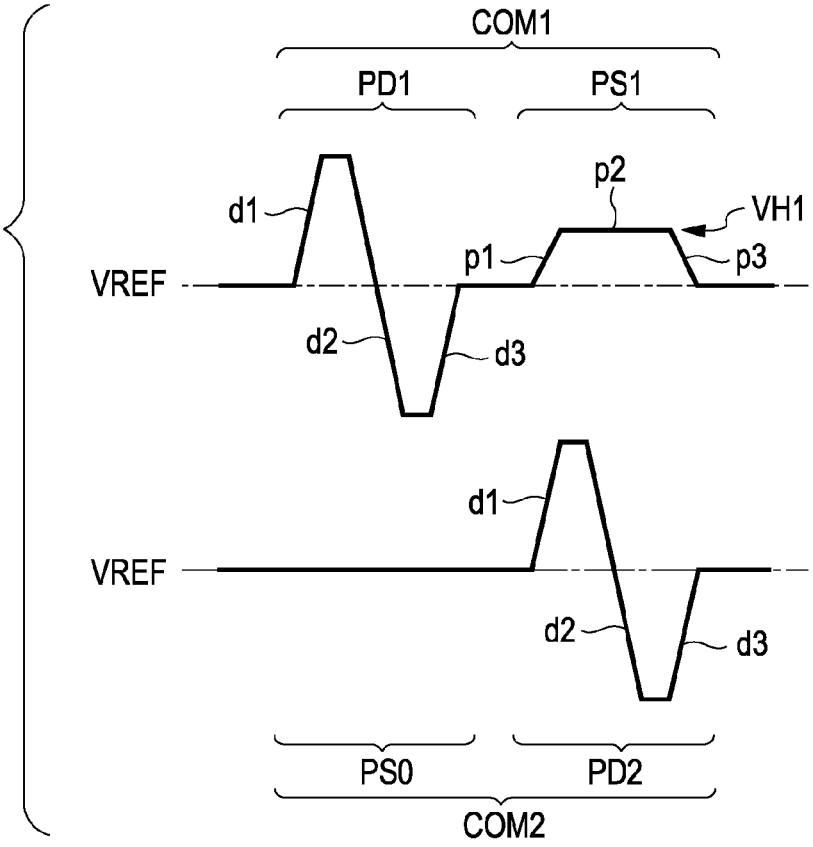
FIG. 5 is a waveform diagram of a driving signal.

The driving signal generating portion 64 creates a driving signal COM1 and a driving signal COM2. Each of the driving signal COM1 and the driving signal COM2 is a periodic signal that drives each piezoelectric vibrator 422. As shown in FIG. 5, an ejection pulse PD1 and a minute vibration pulse PS1 are disposed in one period (a recording period) of the driving signal COM1, and a driving stop element PS0 and an ejection pulse PD2 are disposed in one period of the driving signal COM2.

Each of the ejection pulse PD1 and the ejection pulse PD2 is a driving pulse that vibrates the pressure chamber 50 so that a predetermined amount of ink is ejected from the nozzle 56 when being supplied to the piezoelectric vibrator 422. Specifically, as shown in FIG. 5, each of the ejection pulse PD1 and the ejection pulse PD2 includes a section d1 in which the electric potential is changed from a predetermined standard electric potential VREF to a high rank side (a direction of decompressing the pressure chamber 50), a section d2 in which the electric potential is changed from the standard electric potential VREF to a low rank side, and a section d3 in which the electric potential is changed to the high rank side and returns to the standard electric potential VREF. In addition, it is also possible to adopt a configuration in which the waveforms are different from each other between the ejection pulse PD1 and the ejection pulse PD2.

The minute vibrations pulse PS1 of the driving signal COM1 is a driving pulse that applies a change (hereinafter, referred to as a "minute vibration") in pressure, to the extent that ink within the pressure chamber 50 is not discharged from the nozzle 56, in the pressure chamber 50 when being supplied to the piezoelectric vibrator 422. Specifically, as shown in FIG. 5, the minute vibrations pulse PS1 includes a section p1 in which the electric potential is changed from a predetermined standard electric potential VREF to the electric potential VH1 of the high rank side, a section p2 in which the electrical potential VH1 of the terminal of the section p1 is maintained, and a section p3 in which the electric potential is changed to the lower rank side and returns to the standard electric potential VREF. The waveform of the minute vibrations pulse PS1 is suitably changed. Meanwhile, as shown in FIG. 5, the driving stop element PS0 of the driving signal COM2 is a section in which the electric potential is maintained in the standard electric potential VREF. Thus, the vibration of the piezoelectric vibrator 422 is stopped by the supply of the driving stop element PS0.

The storage portion 62 of FIG. 4 includes a ROM that stores a control program or the like, and a RAM that temporarily stores various data required for printing the image. The control portion 60 collectively controls the respective elements (for example, the print processing portion 104) of the printing apparatus 100 by the execution of the control program stored in the storage portion 62.

Figure 6:
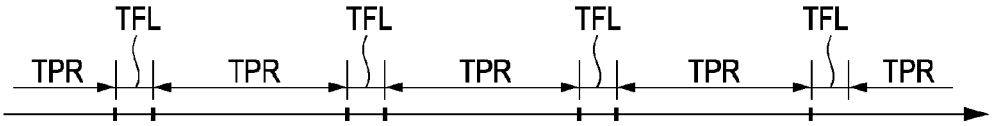
FIG. 6 is an explanatory diagram of the timing of a flushing operation.

As shown in FIG. 6, the operation period of the printing apparatus 100 is classified into a print period TPR and an inter-paper period TFL. The print period TPR is a period during which an image is formed, for example, on a sheet of recording paper 200. The inter-paper period TFL is a period between the respective print periods TPR occurring one after another (that is, a period after the recording of the image on a sheet of recording paper 200 is completed and until the recording of the image on the next recording paper 200 is started). The print period TPR and the inter-paper period TFL are alternately set on a time axis.

The control portion 60 of FIG. 4 causes the recording head 24 to execute an operation of recording an image on the recording paper 200 according to the print data DP by the ejection of ink onto the recording paper 200 at the respective print periods TPR. Specifically, the control portion 60 creates the control data DC for each print period TPR using the print data DP to be supplied from the external device 300 to the external I/F 66. The control data DC is data that instructs the operation of the respective unit ejection portions U.

Specifically, the control portion 60 discriminates the necessity of the ejection of ink in the respective print periods TPR by the analysis of the print data DP for each unit ejection portion U. Moreover, in regard to the unit ejection portion U requiring at least one ejection of ink at the print period TPR, the control portion 60 crates the control data DC that instructs a grayscale value (that is, ejection/non-ejection of ink) according to the print data DP. Meanwhile, in regard to the unit ejection portion U which never requires ejecting ink at the print period TPR, the control portion 60 creates the control data DC that instructs the driving stop of the unit ejection portion U. The driving stop means that neither the ejection of ink from the nozzles 56 nor the application of the minute vibrations relative to the pressure chamber 50 is executed. That is, the control portion 60 functions as a unit (a minute vibration control unit) for controlling the presence or the absence of the giving of the minute vibration relative to the pressure chamber 50.

Furthermore, the control portion 60 also functions as a unit (flushing control unit) for causing the recording head 24 to execute the flushing operation. The flushing operation is an operation of forcibly ejecting ink to the respective unit ejection portions U in the state of moving the recording head 24 to the retracted position (on the cap 18). Ink ejected from each nozzle 56 by the flushing operation is accommodated in the cap 18 of the retracted position. The control portion 60 causes the recording head 24 to execute the flushing operation in the respective inter-paper periods TFL of FIG. 6. In this manner, by periodically executing the flushing operation, the clogging of each nozzle 56 or the entry of air bubbles into the pressure chamber 50 is solved.

Figure 7:
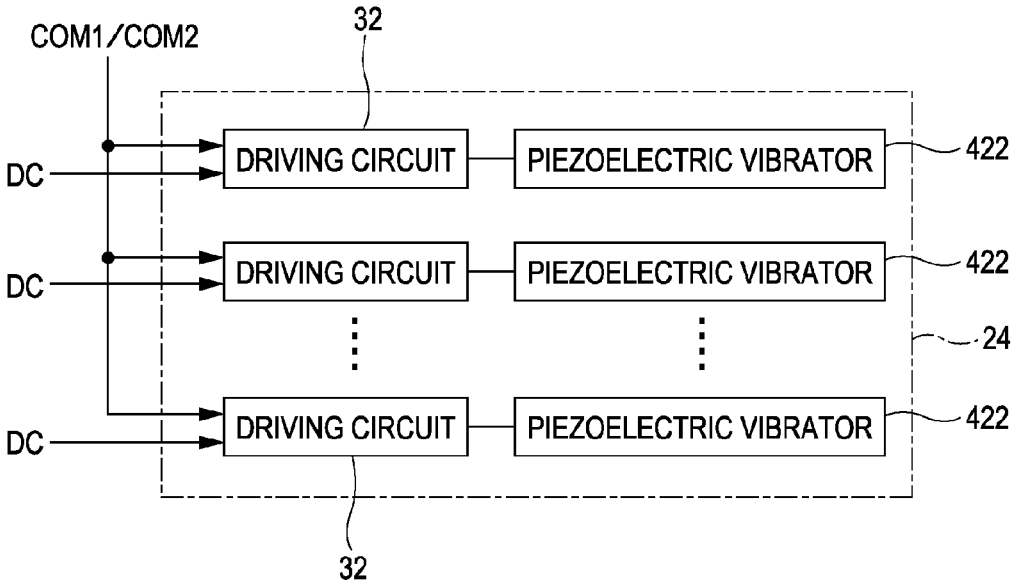
FIG. 7 is a block diagram of an electrical configuration of the recording head.

FIG. 7 is a schematic diagram of an electrical configuration of the recording head 24. As shown in FIG. 7, the recording head 24 includes a plurality of driving circuits 32 corresponding to the unit ejection portions U different from each other. The driving signal COM1 and the driving signal COM2 created by the driving signal generating portion 64 is commonly supplied to the plurality of driving circuits 32 via the internal I/F 68. Furthermore, the control data DC created by the control portion 60 is supplied to the respective driving circuits 32 via the internal I/F 68.

The respective driving circuits 32 selects the section corresponding to the control data DC to be supplied from the control portion 60 from the driving signal COM1 or the driving signal COM2 and supplies the section to the piezoelectric vibrator 422. Specifically, when the control data DC instructs a grayscale value requiring the ejection of ink, the driving circuit 32 selects the ejection pulse PD1 of the driving signal COM1 and the ejection pulse PD2 of the driving signal COM2 and supplies them to the piezoelectric vibrator 422. Thus, ink within the pressure chamber 50 is ejected from the nozzle 56 onto the recording paper 200. Meanwhile, when the control data DC instructs the grayscale value not requiring the ejection of ink, the driving circuit 32 selects the minute vibrations pulse PS1 of the driving signal COM1 and supplies the same to the piezoelectric vibrator 422. Thus, the minute vibrations are applied to the inner portion of the pressure chamber 50, and ink within the pressure chamber 50 is suitably stirred without being ejected.

Furthermore, when the control data DC instructs the driving stop, the driving circuit 32 selects the driving stop element PS0 of the driving signal CO2 and supplies the same to the piezoelectric vibrator 422. Thus, the unit ejection portion U performs neither the ejection of ink nor the minute vibrations, and is stopped. That is, ink within the pressure chamber 50 is not stirred.

Figure 8:
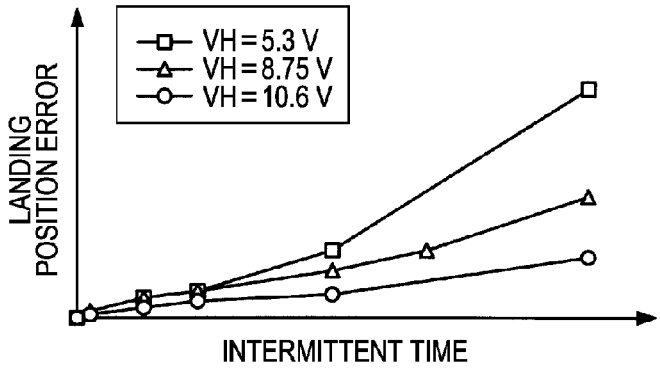
FIG. 8 is a graph that shows a relationship between an intermittent time and a landing position error.

FIG. 8 is a graph for describing an effect of the minute vibrations to be applied to the pressure chamber 50 by the supply of the minute vibrations pulse PS1. A horizontal axis of FIG. 8 refers to the time (an intermittence time) elapsed after the unit ejection portion U finally ejects ink, and a vertical axis of FIG. 8 refers to the distance (a landing position error) between the actual landing position of ink ejected from the unit ejection portion U and a target position. FIG. 8 shows a relationship between the intermittence time and the landing position error in a plurality of cases where the electric potential (a peak value) VH1 of the section p2 of the minute vibrations pulse PS1 is changed.

Ink in the pressure chamber 50 is locally thickened due to the evaporation of moisture or the like from the surface (meniscus) exposed into the nozzle 56. As the thickening of ink progresses, the speed of ink to be ejected from the unit ejection portion U drops. Thus, the landing position error is understood as an indicator of the degree of thickening (as the thickening progresses, the landing position error increases) of ink in the pressure chamber 50. As is understood from FIG. 8, as the intermittence time is prolonged, the thickening of ink in the pressure chamber 50 progresses, resulting in an increase in landing position error.

When the minute vibrations are applied into the pressure chamber 50 by the supply of the minute vibrations pulse PS1, ink within the pressure chamber 50 is stirred. Thus, a thickened ingredient (hereinafter, referred to as a "thickening ingredient") near the nozzle 56 of ink in the pressure chamber 50 is diffused in the pressure chamber 50. The landing position error (a local thickening) is reduced by the diffusion of the ingredient mentioned above. As shown in FIG. 8, as the electric potential VH1 of the minute vibrations pulse PS1 is increase (that is, the intensity of the minute vibrations to be applied to the inner portion of the pressure chamber 50 is high), the effect of a reduction in landing position error becomes more remarkable. That is, a tendency is ascertained from FIG. 8 in which, as the intensity of the minute vibrations increases, the thickening ingredient is more widely diffused in the pressure chamber 50.

Figure 9:
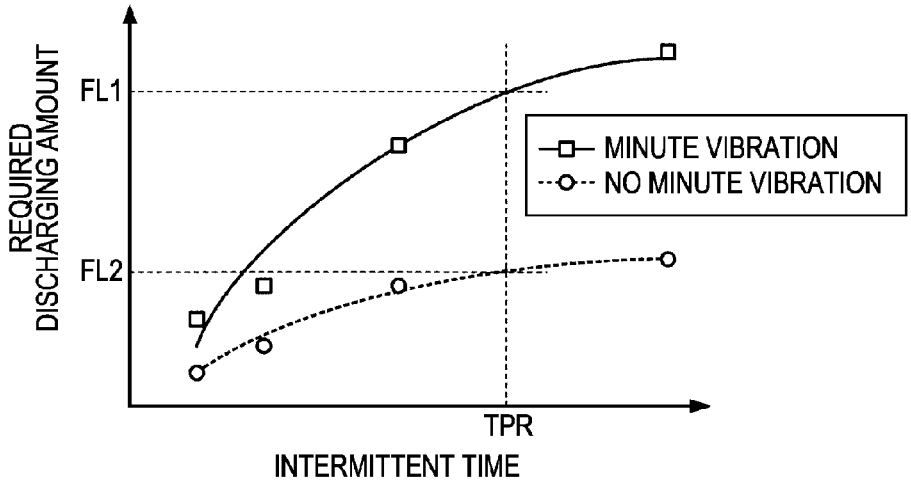
FIG. 9 is a graph that shows a relationship between the intermittence time and a necessary ejection quantity by the flushing operation.

FIG. 9 is a graph that shows a relationship between the intermittence time (horizontal axis) and the ejection quantity required for the flushing operation. The vertical axis of FIG. 9 refers to an ejection quantity (hereinafter, referred to as a "required ejection quantity") required for sufficiently suppressing (ideally making the landing position error zero) the landing position error due to the thickening of ink by the flushing operation. Since the thickening of ink progresses as the intermittence time lengthens, as is understood from FIG. 9, the required ejection quantity increases.

FIG. 9 shows a relationship between the intermittence time and the required ejection quantity in regard to each of the case of applying the minute vibrations to the pressure chamber 50 (the solid line) and the case of not applying the minute vibrations (dashed line). As mentioned above, as the intensity of the minute vibrations is high, the thickening ingredient of ink is widely diffused in the pressure chamber 50. Moreover, the distribution of the thickening ingredient is widely diffused, the discharging quantity of ink (required ejection quantity of ink) required for sufficiently ejecting the thickening ingredient by the flushing operation is increased. For example, as is understood from FIG. 9, the required ejection quantity (for example, FL1) of the case of applying the minute vibrations into the pressure chamber 50 exceeds the required ejection quantity (for example, FL2) of the case of not giving the minute vibrations. That is, a tendency is ascertained in which, as the intensity of the minute vibrations is high, the ejection quantity required for the flushing operation is increased.

On the background of the tendency mentioned above, the control portion 60 (the flushing control unit) causes the respective unit ejection portions U to execute the flushing operation for each inter-paper period TFL so that the ejection quantity (hereinafter, referred to as a "flushing ejection quantity") of ink in the flushing operation in each inter-paper period TFP is changed according to the presence or the absence (strength or weakness) of the minute vibrations of the respective unit ejection portions U of the previous print period TPR. Specifically, the control portion 60 controls the recording head 24 (the respective unit ejection portions U) so that the flushing ejection quantity FL2 from the unit ejection portion U (the unit ejection portion U to which the minute vibrations are not applied at the print period TPR), in which the driving stop is instructed at the previous print period TPR, is lower than the flushing ejection quantity FL1 form the unit ejection portion U (that is, the unit ejection portion U which ejects ink once at the print period TPR) to which the minute vibration is given at the print head TPR. As shown in FIG. 9, the flushing ejection quantity FL1 and the flushing ejection quantity FL2 are set to required ejection quantities (for example, required ejection quantities for reducing the landing position error to zero) of the case setting the intermittence time to the time length of the print period TPR.

The control portion 60 supplies the control data DC instructing the ejection of ink to the respective driving circuits 32, and causes the respective unit ejection portions U to execute the flushing operation (that is, the selection of the ejection pulse PD1 and the ejection pulse PD2) in each inter-paper period TFL. By setting the number of ink ejections in the inter-paper period TFL by the supply of the control data DC according to the presence or the absence of the minute vibrations at the previous print period TPR, the flushing ejection quantity from the respective unit ejection portions U is variably controlled according to the presence or the absence of the minute vibrations at the print period TPR.

In the first embodiment mentioned above, the flushing ejection quantities of the respective unit ejection portions U are variably controlled according to the presence or the absence of the minute vibrations (that is, the presence or the absence of the diffusion of the thickening ingredient) at the print period TPR. Specifically, the flushing ejection quantity is set such that the flushing ejection quantity FL2 from the unit ejection portion U to which the minute vibrations are not applied (that is, the diffusion of the thickening ingredient due to the minute vibrations is not generated) in the print period TPR is lower than the flushing ejection quantity FL1 from the unit ejection portion U to which the minute are applied (that is, the thickening ingredient is diffused in the pressure chamber 50). Thus, the amount of consumption of ink due to the flushing operation is reduced as compared to the configuration in which the respective unit ejection portions U eject ink of the flushing ejection quantity FL1 regardless of the presence or the absence (strength) of the minute vibrations. Furthermore, for example, as compared to the configuration in which the respective unit ejection portions U eject ink of the flushing ejection quantity FL2 regardless of the presence or the absence of the minute vibrations, it is possible to sufficiently eject the diffused thickening ingredient into the pressure chamber 50 by the minute vibrations. That is, according to the first embodiment, there is an advantage in that the amount of ink consumed due to the flushing operation can be reduced while sufficiently maintaining a desired effect (the solution to clogging of the nozzle 56 or entry of air bubbles into the pressure chamber 50) of the flushing operation.

B: Second Embodiment

A second embodiment of the invention will be described below. In addition, in the respective aspects described below, elements having the same actions or functions as those of the first embodiment are denoted by the reference numerals of the description above, and the respective detailed descriptions thereof will be suitably omitted.

As shown in FIG. 2, a plurality of nozzles 56 formed on the discharging surface 26 of the recording head 24 is divided into a first group G1 which is used in both of the monochrome printing (a grayscale printing) and the color printing, and a second group G2 that is used only in the color printing. Specifically, the respective nozzles 56 of the nozzle group 28K corresponding to ink of black (K) is divided into the first group G1, and the respective nozzles 56 of each of the nozzle group 28Y, the nozzle group 28M, and the nozzle group 28C ejecting ink of color are divided into the second group G2.

The control portion 60 of the second embodiment functions as a unit (an operation mode control unit) that sets the operation mode of the printing apparatus to any one of the color print mode and the monochrome print mode. The color print mode (an example of the first operation mode) is an operation mode which records the color image on the recording paper 200 using each nozzle 56 of both of the first group G1 and the second group G2, and the monochrome print mode (an example of the second operation mode) is an operation mode which records the monochrome image on the recording paper 200 only using the respective nozzles 56 of the first group G1. An external device 300, for example, instructs the operation mode according to the instruction from a user to the control portion 60. The control portion 60 selects the operation mode (the color print mode/the monochrome print mode) instructed from the external device 300.

When the color print mode is selected, the control portion 60 creates the control data DC which instructs the grayscale value (that is, ejection/non-ejection of ink) according to the print data DP in regard to the respective unit ejection portions U (all the unit ejection portions U) of both of the first group G1 and the second group G2. Thus, at the print period TPR, in the respective unit ejection portions U of both of the first group G1 and the second group G2, the ejection of ink to the recording paper 200 or the application of the minute vibrations to the pressure chamber 50 is executed.

Meanwhile, in the monochrome print mode, the ejection of ink by the respective unit ejection portions U of the second group G2 is stopped. Thus, the control portion 60 creates the control data DC instructing the grayscale value according to the print data DP in regard to the respective unit ejection portions U of the first group G1, and creates the control data DC instructing the driving stop in regard to the respective unit ejection portions U of the second group G2. Thus, at the print period TPR, the ejection of ink to the recording paper 200 or the application of the minute vibrations to the pressure chamber 50 is executed in the respective unit ejection portions U of the first group G1, and neither the ejection of ink to the recording paper 200 nor the application of the minute vibrations is executed in the respective unit ejection portions U of the second group G2.

Similar to the first embodiment, the control portion 60 causes the respective unit ejection portions U to execute the flushing operation for each inter-paper period TFL so that the flushing ejection quantity in each inter-paper period TFL is changed according to the presence or the absence of the minute vibrations of the respective unit ejection portions U in the print period TPR. Specifically, in the inter-paper period TFL of the color print mode, the control portion 60 controls the flushing operation of the respective unit ejection portions U so that ink of the flushing ejection quantity FL1 is ejected from the respective unit ejection portions U of both of the first group G1 and the second group G2. Meanwhile, in the inter-paper period TFL of the monochrome print mode, the control portion 60 controls the flushing operation of the respective unit ejection portions U so that ink of the flushing ejection quantity FL1 is ejected from the respective unit ejection portions U of the first group G1 to which the minute are applied at the previous print period TPR, and ink of the flushing ejection quantity FL2 (FL2<FL1) is ejected from the respective unit ejection portions U of the second group G2 to which the minute vibrations are not applied at the previous print period TPR.

That is, in the first embodiment, the presence or the absence of the minute vibrations in the pressure chamber 50 and the flushing ejection quantity are set according to the print data DP. However, in the second embodiment, the presence or the absence of the minute vibrations in the pressure chamber 50 and the flushing ejection quantity are set according to the operation mode (the color print mode/the monochrome print mode). Even in the second embodiment mentioned above, the same effect as that of the first embodiment is realized. Furthermore, in the second embodiment, since the presence or the absence of the minute vibrations and the flushing ejection quantity are set according to the operation mode, there is an advantage in that the processing of the control portion 60 is simplified as compared to the first embodiment in which the presence or the absence of the minute vibrations in the pressure chamber 50 and the flushing ejection quantity are set for each unit ejection portion U according to the print data DP.

C: Third Embodiment

In the first embodiment, the minute vibrations were stopped on the unit ejection portion U to which ink is never ejected once at the print period TPR. The control portion 60 of the third embodiment gives the pressure chamber 50 of the unit ejection portion U, to which ink is not even ejected once at the print period TPR, the minute vibrations having weak intensity as compared to the minute vibrations to be applied to the unit ejection portion U to which ink is ejected at the print period TPR.

Figure 10:
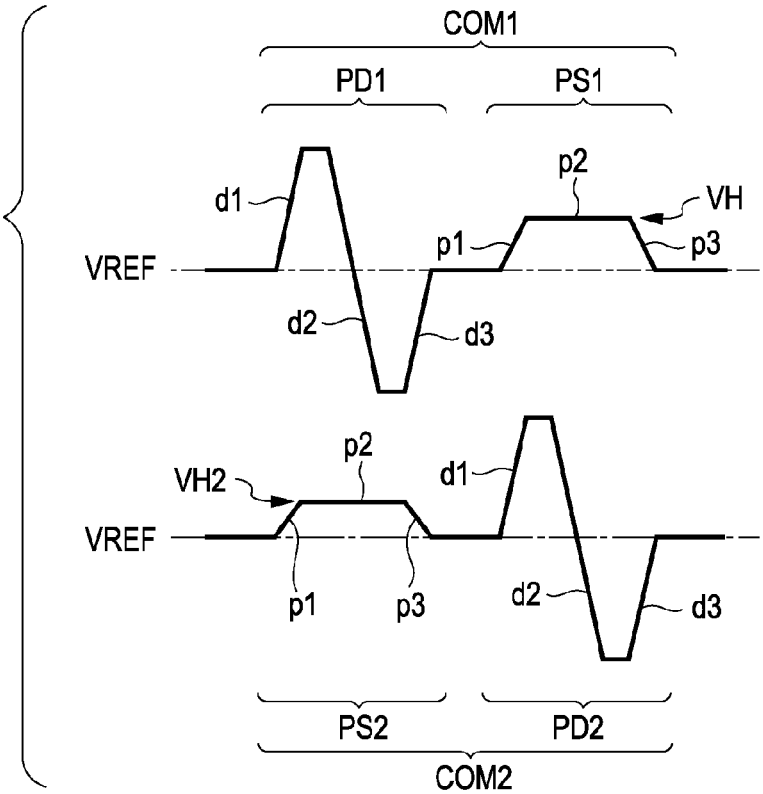
FIG. 10 is a waveform diagram of a driving signal in a third embodiment.

FIG. 10 is a waveform view of a driving signal COM1 and a driving signal COM2 in a third embodiment. As shown in FIG. 10, like the first embodiment, the driving signal COM1 includes the ejection pulse PD1 and the minute vibrations pulse PS1. Meanwhile, the driving signal COM2 is a waveform in which the driving stop element PS0 of the first embodiment is replaced with the minute vibrations pulse PS2, and includes the minute vibrations pulse PS2 and the ejection pulse PD2.

Like the minute vibrations pulse PS1 of the driving signal COM1, the minute vibrations pulse PS2 of the driving signal COM2 is a waveform of a trapezoidal shape which includes the section p1, the section p2, and the section p3. However, the intensity (the power or the amplitude) 62 of the minute vibrations to be applied to the pressure chamber 50 by the supply of the minute vibrations pulse PS2 is lower than the intensity $\sigma 1$ of the minute vibrations to be applied to the pressure chamber 50 by the supply of the minute vibrations pulse PS1 ($\sigma 2<\sigma 1$). Specifically, the electric potential VH2 of the section p2 of the minute vibrations pulse PS2 is lower than the electric potential VH1 of the section p2 of the minute vibrations pulse PS1, and the gradient of the section p1 or the section p3 of the minute vibrations pulse PS2 is gradual compared to gradient of the section p1 or the section p3 of the minute vibrations pulse PS1. When the control data DC instructing the driving stop is supplied (that is, when the unit ejection portion U does not eject ink at the print period TPR), the driving circuit 32 selects the minute vibrations pulse PS2 of the driving signal COM2 and supplies the piezoelectric vibrator 422 with the same. Thus, the minute vibrations of intensity $\sigma 2$ are applied to the pressure chamber 50.

As described with reference to FIG. 9, as the intensity of the minute vibrations is high, the required flushing quantity is increased. Thus, the control portion (the flushing control unit) causes the respective unit portions U to execute the flushing operation so that the flushing ejection quantity within the respective inter-paper periods TFL is changed according to the intensity of the minute vibrations given to the respective unit ejection portions U at the previous print period TPR. That is, the control portion 60 controls the flushing ejection quantities of the respective unit ejection portions U such that the flushing ejection quantity (FL2) of the unit ejection portion U (that is, the unit ejection portion to which ink is never ejected once within the print period TPR), to which the minute vibrations of intensity $\sigma 2$ is given at the previous print period TPR, is lower than the flushing ejection quantity (FL1) of the unit ejection portion U (that is, the unit ejection portion to which ink is ejected at the print period TPR) to which the minute vibrations of intensity $\sigma 1$ is given at the print period TPR.

Even in the third embodiment, the same effect as that of the first embodiment is realized. Furthermore, in the third embodiment, since the minute vibrations of intensity $\sigma 2$ is also given to the unit ejection portion U to which ink is not ejected within the print period TPR, there is an advantage in that the thickening of ink in the pressure chamber 50 can be effectively prevented. In addition, in the description mentioned above, although the configuration based on the first embodiment was described as an example, the same configuration can also be applied to the second embodiment. That is, it is possible to adopt a configuration in which the minute vibrations of different intensities are given to the respective pressure chambers 50 according to the operation mode (the monochrome print mode/the color print mode).

As is understood from the examples of the respective aspects, the control portion 60 (the minute vibration control unit) is included as an element that variably controls the intensity of the minute vibrations to be applied to the respective pressure chambers 50, and a concept of the intensity of the minute vibrations implies both of the strength or the weakness of the minute vibrations (the third embodiment) and the presence and the absence of the minute vibrations (the first embodiment). That is, assuming a case where the intensity of the minute vibrations is variably set to any one of a plurality of intensities including the first intensity and the second intensity lower than the first intensity, actually, the second intensity includes both of the intensity lower than the first intensity within the range generating pressure fluctuations in the pressure chamber 50 and the intensity (that is, intensity zero equivalent to the stop (off) of the minute vibrations) which does not generate pressure fluctuations in the pressure chamber 50.

D: Modified Example

The respective forms are variously transformed. The forms of the respective transformations will be described as below. Two or more forms arbitrarily selected from the examples as below can be suitably merged with each other.

1. FIRST MODIFIED EXAMPLE

In the first embodiment and the second embodiment, the minute vibrations of the pressure chamber 50 was stopped by supplying the driving stop element PS0 (the standard electric potential VREF) of the driving signal COM2 to the unit ejection portion U (the piezoelectric vibrator 422) to which ink is not ejected within the print period TPR, but the method of stopping the minute vibrations is arbitrary. For example, it is also possible to adopt a configuration in which the minute vibrations of the pressure chamber 50 is stopped by stopping the supply of the standard electric potential VREF to the piezoelectric vibrator 422 (that is, electrically insulating the piezoelectric vibrator 422 and the supply lines of the driving signal COM1 and the driving signal COM2). In the configuration mentioned above, since there is no need for the driving of the unit ejection portion U including the supply of the standard electric potential VREF, the supply of the control data DC can also be omitted in regard to the unit ejection portion U to which ink is not ejected within the print period TPR. Thus, there is an advantage in that the configuration or the processing of the control portion 60 is simplified and the electric power consumption is reduced.

2. SECOND MODIFIED EXAMPLE

The respective forms mentioned above, the flushing operation was executed at the inter-paper period TFL between the respective print periods TPR by setting the period, during which the image is formed on a sheet of recording paper 200, as the print period TPR, but the cycle of the flushing operation is arbitrary. For example, it is also possible to adopt a configuration in which the flushing operation is executed between the respective print periods TPR by setting the period (that is, a period during which a part of the image is formed on the recording paper 200), during which the carriage 12 reciprocates over a predetermined number while ejecting ink onto the recording paper 200, as the print period TPR. Furthermore, the position, where the flushing operation is executed, is not limited to the retracted position of the outside of the range in which the discharging surface 26 faces the recording paper 200. For example, it is also possible to adopt a configuration in which the flushing operation is executed in the state where the discharging surface 26 is within the range facing the recording paper 200. Since ink ejected to the recording paper 200 by the flushing operation is sufficiently small compared to the original ink to be ejected according to the print data DP, in practice, most of them are not perceived.

3. THIRD MODIFIED EXAMPLE

In the respective forms mentioned above, although the driving signals (COM1 and COM2) of a plurality of systems were supplied to the recording head 24, it is also possible to adopt a configuration in which only the driving signal of one system is used in the driving of the respective piezoelectric vibrators 422, or a configuration in which the driving signals of three systems or more are used in the driving of the respective piezoelectric vibrators 422. In the configuration in which the driving signal of one system is used, for example, the driving signal, in which the ejection pulse PD1, the minute vibrations pulse PS1, and the driving stop element PS0 (or the minute vibrations pulse PS2) are arranged in a time series, is supplied to the recording head 24.

Furthermore, the waveforms of the respective pulses (PD1, PD2, PS1, and PS2) of the driving signal are arbitrary. For example, it is also possible to adopt, for example, a rectangular pulse without being limited to the trapezoidal pulse shown in FIG. 5 or FIG. 10. The waveforms of the minute vibrations pulses (PS1 and PS2) of the driving signal can be arbitrarily changed without being limited to the examples of FIG. 5 or FIG. 10 if the waveforms oscillate ink (meniscus) to the extent that ink in the pressure chamber 50 is not discharged from the nozzle 56.

4. FOURTH MODIFIED EXAMPLE

In the respective embodiments mentioned above, the driving signals (COM1 and COM2), by which ink is ejected to the respective unit ejection portions U at the print period TPR, was also used in the flushing operation within the inter-paper period TFL, but it is also possible to adopt a configuration in which the driving signal dedicated so as to cause the respective unit ejection portions U to execute the flushing operation is created separately from the driving signals (COM1 and COM2) used at the print period TPR.

5. FIFTH MODIFIED EXAMPLE

The time length of the print period TPR (the intermittence time) is changed according to the content of the image indicated by the print data DP, the condition of the printing (for example, resolution or print quality) or the like. Meanwhile, as described with reference to FIG. 9, the required ejection quantity is changed according to the intermittence time. Thus, it is also possible to adopt a configuration in which the flushing ejection quantity of the unit ejection portion U (that is, the unit ejection portion U to which the minute vibrations are not applied or the unit ejection portion U to which the minute vibrations of intensity $\sigma$2 is given), to which ink is not ejected at the print period TPR, is variably set according to the time length of the previous print period TPR. For example, as is understood from FIG. 9, since the required ejection quantity increases as the intermittence time lengthens, a configuration is preferable in which the control portion 60 controls the flushing operations of the respective unit ejection portions U such that the flushing ejection quantity at the inter-paper period TFL increases as the time length of the print period TPR lengthens.

6. SIXTH MODIFIED EXAMPLE

In the respective forms mentioned above, the piezoelectric vibrator 422 of the longitudinal vibration type was described as an example, but the configuration of the element (the pressure generating element) changing the pressure in the pressure chamber 50 is not limited to the example mentioned above. For example, it is also possible to use a vibrating body such as a piezoelectric vibrator 422 of a deflection vibration type or an electrostatic actuator. Furthermore, the pressure generating element of the invention is not limited to an element which gives the pressure chamber 50 the mechanical vibration. For example, it is also possible to use a heating element (a heater), which generate the air bubbles by the heating of the pressure chamber 50 to change the pressure in the pressure chamber 50, as the pressure generating element. That is, the pressure generating element of the invention is included as an element changing the pressure in the pressure chamber 50, and the method (a piezoelectric type/a thermal type) of changing the pressure or the configuration thereof is unquestioned.

7. SEVENTH MODIFIED EXAMPLE

The printing apparatus 100 of each form mentioned above can be adopted to various devices such as a plotter, a facsimile device, and a copier. The application of the liquid ejecting apparatus of the invention is not limited to the printing of the image. For example, the liquid ejecting apparatus ejecting solutions of each color material is used as a manufacturing apparatus that forms the color filter of the liquid crystal display device. Furthermore, the liquid ejecting apparatus ejecting a liquid conductive material is used as, for example, an electrode manufacturing apparatus that forms an electrode of a display device such as an organic EL (Electroluminescence) display device or a field emission display (FED). Furthermore, the liquid ejecting apparatus ejecting a solution of a bio-organic substance is used as a chip manufacturing device that manufactures the biochip.

Furthermore, in the respective forms mentioned above, a serial type printing apparatus 100 was described as an example in which the carriage 12 with the recording head 24 mounted thereon is moved in the main scanning direction, but it is possible to apply the invention to a printing apparatus using a line type recording head which is configured in a form with long length in the main scanning direction so that a plurality of nozzles is arranged over all regions in the width direction of the recording paper.

The entire disclosure of Japanese Patent Application No. 2010-223578, filed Oct. 1, 2010 is expressly incorporated by reference herein.

What is claimed is:

1. A liquid ejecting apparatus comprising:

unit ejection portions that includes a pressure chamber filled with liquid, nozzles which communicate with the pressure chamber, and a pressure generating element that varies the pressure within the pressure chamber, and ejects liquid within the pressure chamber from nozzle according to fluctuations of the pressure within the pressure chamber;

a minute vibration control unit that controls the unit ejection portions so that minute vibrations having variable intensity are applied to the pressure chamber, wherein the minute vibrations do not cause the liquid in the pressure chambers to be ejected; and a flushing control unit that causes the respective unit ejection portions to execute a flushing operation so that an ejection quantity of liquid by the flushing operation of the pressure chamber, to which the minute vibrations of a first intensity is given, exceeds an ejection quantity of liquid by the flushing operation of the pressure chamber to which the minute vibration of a second intensity lower than the first intensity is given.

2. The liquid ejecting apparatus according to claim 1, wherein the minute vibration control unit controls the unit ejection portion so that the minute vibrations of any one of the first intensity and the second intensity is applied to the pressure chamber, and the second intensity corresponds to the stop of the minute vibrations.

3. The liquid ejecting apparatus according to claim 2, wherein the minute vibrations is stopped by maintaining an electric potential to be supplied to the pressure generating element to a predetermined value.

4. The liquid ejecting apparatus according to claim 2, wherein the minute vibrations is stopped by stopping the supply of an electric potential to the pressure generating element.

5. The liquid ejecting apparatus according to claim 1, wherein the minute vibration control unit discriminates the necessity of the ejection of liquid of the unit ejection portion according to the print data, causes the unit ejection portion necessary for the ejection of liquid to execute the ejection of liquid or the application of the minute vibrations to the pressure chamber according to the print data, and causes the unit ejection portion unnecessary for the ejection of liquid to execute the application of the minute vibrations of the second intensity.

6. The liquid ejecting apparatus according to claim 1, wherein a plurality of unit ejection portions is divided into a first group and a second group, the liquid ejecting apparatus further includes an operation mode control unit that selects any one of a first operation mode of ejecting liquid from each unit ejection portion of both of the first group and the second group and a second operation mode of ejecting liquid from each unit ejection portion of the first group and stopping the ejection of liquid by each unit ejection portion of the second group, the minute vibration control unit causes each unit ejection portion of both of the first group and the second group to execute the ejection of liquid or the application of the minute vibrations of the first intensity to the pressure chamber according to the print data when the operation mode control unit selects the first operation mode, and the minute vibration control unit causes each unit ejection portion of the first group to execute the ejection of liquid or the application of the minute vibrations of the first intensity to the pressure chamber according to the print data and causes the unit ejection portions corresponding to each nozzle of the second group to execute the application of the minute vibrations of the second intensity to the pressure chamber when the operation mode control unit selects the second operation mode.

7. The liquid ejecting apparatus according to claim 1, wherein the flushing operation causes the liquid in the pressure chambers to be ejected onto a target.

* * * * *